US007484955B2

(12) United States Patent
Flynn et al.

(10) Patent No.: US 7,484,955 B2
(45) Date of Patent: Feb. 3, 2009

(54) METHOD FOR CONTROLLING AIR DISTRIBUTION IN A CYCLONE FURNACE

(75) Inventors: Thomas J. Flynn, North Canton, OH (US); Ralph T. Bailey, Uniontown, OH (US); Timothy A. Fuller, North Canton, OH (US); Charles E. A. Finney, Knoxville, TN (US); C. Stuart Daw, Knoxville, TN (US)

(73) Assignee: Electric Power Research Institute, Inc., Charlotte, NC (US)

( * ) Notice: Subject to any disclaimer, the term of this patent is extended or adjusted under 35 U.S.C. 154(b) by 140 days.

(21) Appl. No.: 11/538,578

(22) Filed: Oct. 4, 2006

(65) Prior Publication Data

US 2008/0050684 A1 Feb. 28, 2008

Related U.S. Application Data

(60) Provisional application No. 60/823,568, filed on Aug. 25, 2006.

(51) Int. Cl.
*F23M 3/00* (2006.01)

(52) U.S. Cl. ..... 431/9; 431/8; 431/10; 431/75; 431/116; 431/281; 110/348; 110/213; 110/203; 700/274; 700/299; 700/300; 126/19.5; 137/15 E; 137/15 R

(58) Field of Classification Search ..... 431/9, 431/2, 8, 10, 350, 12, 18, 75, 76, 79, 116, 431/176, 278, 281; 110/348, 213, 203, 185–192; 126/79, 115, 173, 19.5; 700/274, 299, 300; 137/82; 236/15 E See application file for complete search history.

(56) References Cited

U.S. PATENT DOCUMENTS

| | | | | | |
|---|---|---|---|---|---|
| 2,594,312 | A | * | 4/1952 | Kerr et al. | 122/235.28 |
| 2,760,508 | A | * | 8/1956 | Dickey | 137/82 |
| 2,822,786 | A | * | 2/1958 | Kolling | 122/240.1 |
| 4,425,855 | A | * | 1/1984 | Chadshay | 110/263 |
| 5,404,298 | A | | 4/1995 | Wang et al. | |
| 5,465,219 | A | * | 11/1995 | Jeffers | 700/274 |
| 6,325,002 | B1 | * | 12/2001 | Ashworth | 110/345 |
| 6,775,645 | B2 | | 8/2004 | Daw et al. | |
| 6,901,351 | B2 | | 5/2005 | Daw et al. | |

(Continued)

OTHER PUBLICATIONS

Khesin, et al; Demonstration Tests of New Burner Diagnostic System on a 650 MW COA-Fired Utility Boiler; "Proceedings of the American Power Conference"; 1997; pp. 325-330; vol. 59-1; Illinois Institute of Technology; Chicago, Illinois.

(Continued)

*Primary Examiner*—Steven B McAllister
*Assistant Examiner*—Avinash Savani
(74) *Attorney, Agent, or Firm*—Trego, Hines & Ladenheim, PLLC

(57) ABSTRACT

Methods for cyclone boiler flame diagnostics and control, including methods for monitoring the operating state of a cyclone furnace using linear and nonlinear signal analysis techniques, including temporal irreversibility and symbol sequence. Adjustments may be made in the air flow distribution to optimize performance. Signals for the main flame and lighter scanners are relatively independent, thereby allowing for independent control of the primary air flow to the burner and secondary air flow to the barrel.

13 Claims, 7 Drawing Sheets

U.S. PATENT DOCUMENTS

| | | | | |
|---|---|---|---|---|
| 7,137,809 | B2 * | 11/2006 | Bueche et al. | 431/12 |
| 2006/0115779 | A1 * | 6/2006 | Yamamoto et al. | 431/115 |

OTHER PUBLICATIONS

Krueger, et al; Illinois Power's On-Line Operator Advisory System to Control Nox and Improve Boiler Efficiency: an Update; "Proceedings of the American Power Conference"; 1997; pp. 331-335; vol. 59-1; Illinois Institute of Technology; Chicago, Illinois.

Adamson, et al; Boiler Flame Monitoring Systems For Low Nox Applications-an Update; "Proceedings of the American Power Conference"; 1997; pp. 340-344; vol. 59-1; Illinois Institute of Technology; Chicago, Illinois.

Khesin, et al.; 6th International ISA/POWIN/EPRI Controls & Instrumentation Conference; "Application of a Flame Spectra Analyzer for Burner Balancing"; Jun. 1996; pp. 1-10; Baltimore, Maryland.

Fuller et al; Proceedings of the ASME Heat Transfer Division; "Enhancing Burner Diagnostics and Control with Chaos-Based Signal Analysis Techniques"; HTD-vol. 335; vol. 4; pp. 281-291; ASME 1996.

Green, Jr. et al.; "Time Irreversibility and Comparison of Cyclic-Variability Models"; 1998; Detroit, Michigan.

* cited by examiner

METHOD FOR CONTROLLING AIR DISTRIBUTION IN A CYCLONE FURNACE

TECHNICAL FIELD AND BACKGROUND OF INVENTION

The present invention relates to methods for cyclone boiler flame diagnostics and control. More particularly, the present invention provides methods for monitoring the operating state of a cyclone furnace using linear and nonlinear signal analysis techniques, including temporal irreversibility and symbol sequence. Adjustments may be made in the air flow distribution to optimize performance. Economic pressures and increasingly restrictive environmental regulations have contributed to an increasing need for advanced control systems that efficiently regulate utility boilers. Inefficient boiler control is responsible for wasting large amounts of fuel and releasing nitrogen oxide pollutants into the atmosphere.

In particular, industrial and utility cyclone boiler operators need a better indication of the overall combustion condition in the cyclone furnace. A cyclone furnace consists of two combustion cavities—the burner and the barrel. There are three common types of burners—radial, scroll and vortex. Although the arrangements differ slightly, the basic principles of operation for each type are the same. In the burner, primary air and tertiary air are combined with crushed coal to ignite the coal. The purpose of the primary air is to ignite the coal. The purpose of the tertiary air is to cool the burner face and provide axial momentum to force the combustion products out of the burner and into the barrel. The partially combusted coal and combustion gases pass into the barrel where secondary air is added. Combustion air in the burner and the barrel is introduced tangentially to create a swirling flow of air and gas that forces the burning coal to the walls of the combustion chambers. In the barrel, a recirculation pattern of air and combustion gases is created in the outer annulus of the cavity from the re-entrant throat end of the barrel back toward the burner, and then back through the barrel in a center vortex exiting the barrel through the re-entrant throat. In the burner, the temperature of the coal particles and residual ash is below the ash melting temperature, so the particles of coal and ash pass out of the burner without sticking to the walls of the burner. In the barrel however, the temperature of the coal and ash reaches the ash melting temperature. A pool of slag (melted ash) forms on the bottom and sides of the barrel. This molten slag serves to hold the large coal particles in place while combustion of the coal particle is completed. It is essential for the efficient operation of the cyclone for this slag layer to remain in a molten state. The product gases and a small amount of ash and unburned coal char pass out of the barrel through the re-entrant throat and into the main boiler cavity where combustion is completed. The molten slag is continuously removed from the cyclone barrel through a spout at the re-entrant throat known as a slag tap.

Historically, the cyclonic flow in the cyclone furnace has led to very high combustion temperatures, which, although providing very efficient combustion, has also led to high $NO_x$ emissions. The high $NO_x$ emissions were due to both the nitrogen in the fuel (fuel $NO_x$) and thermal or prompt $NO_x$ from the dissociation of nitrogen in the air and oxidation to NO. Industry's response to this problem was to stage the combustion in the cyclone. This was achieved by providing less than the stoichiometric amount of air required to completely burn the coal, and providing the balance of the air required to complete combustion through additional ports in the boiler known as over-fire air ports. This has two beneficial impacts on $NO_x$ emissions. First, in the absence of sufficient oxygen, the fuel nitrogen will recombine with itself to form molecular nitrogen rather than NO. Second, since less fuel is burned in the barrel, the operating temperature is lower, and therefore, the thermal $NO_x$ is reduced.

Although $NO_x$ emissions have been reduced considerably with this technique it has led to two significant operational problems. First, under reducing conditions (i.e., stoichiometries less than 1.0 molar ratio of air/fuel) corrosion and wastage of the refractory walls of the cyclone barrel is accelerated. Second, lower temperatures in the cyclone barrel may cause the temperature of the molten slag to fall below its melting temperature and freeze. If the slag freezes, the burning coal particles that exit the burner will not adhere to the walls of the barrel and will be ejected from the cyclone before the combustion can be completed. This leads to high unburned carbon losses from the boiler and lower boiler efficiency. If the slag tap opening is plugged with frozen slag, the cyclone may have to be shut down to remove the slag manually. An additional complicating factor is that the melting temperature of the slag is a strong function of the properties of the coal. Since utility and industrial boiler owners buy coal with a wide range of properties to reduce the operating cost of the boiler, the melting temperature of the slag can vary considerably day-to-day. Further, other characteristics of the coal, such as moisture and grind size can negatively impact combustion in the cyclone.

Currently, operators must make visual observations of each cyclone to monitor the condition of slag in the barrel and the quality of combustion. This is a qualitative inspection, and varies from operator to operator. If the operator observes that the slag is beginning to freeze, the lighter, which is typically only used for startup, may be used to increase the temperature of the slag and melt the slag layer. Since the lighter typically uses a premium fuel such as natural gas or oil, this is an expensive corrective action. Also, by increasing the operating temperature of the barrel, the $NO_x$ emissions may also increase. Some units are equipped with secondary air dampers that are split into two or three sections. The operator can adjust the position of these dampers to redistribute the secondary air along the length of the barrel to concentrate more air in the vicinity where the slag is freezing. This action increases combustion in the vicinity of the frozen slag and consequently raises the temperature of the slag. This requires frequent visual inspections on the part of the operator to closely follow the situation.

Periodically, it is necessary for the operator to tune the cyclones to optimize the performance or to accommodate a change in the cyclone (e.g., coal properties, hardware changes, refractory replacement, etc.). The procedure for tuning the cyclones to optimize performance is iterative and time-consuming. Temporary, expensive gas sample grids must be installed in the flue at the exhaust of the boiler to measure the concentration of carbon monoxide and unburned carbon in the combustion gases. From these measurements, the boiler operator must infer changes that need to be made to the air distribution on a trial-and-error basis to improve performance.

A monitoring technique is therefore needed that can assess the quality of combustion in the burner and barrel, and provide guidance to the operator to make adjustments in the air distribution to maintain optimum performance without resorting to expensive gas grids. In this invention as described below, the techniques are proven to be helpful in providing the cyclone furnace operators with a better indication of the cyclone operating status. Further, a method to control the air distribution within cyclones using the analysis results is described. Improving the air distribution and reducing the cyclone down time are important benefits of this invention.

The flame physics in a cyclone barrel differ significantly from the physics in a wall-fired burner. There are two non-obvious elements to the invention. First, prior to the discovery contained in this application it was not known whether or not it would be possible to correlate the flame characteristics with excess air, air distribution, $NO_x$ emissions, slag tap operation or some other aspects of cyclone operation. Although the means have been developed to reliably acquire the flame scanner signals and analyze those signals in real time, the analysis techniques in U.S. Pat. Nos. 6,775,645 B2 and 6,901,351 B2 were developed for pulverized coal combustion rather than cyclone furnaces. Prior to this invention it was not clear what issues may need to be addressed to extend the technology to cyclones. The primary effort in the development program was to modify the existing algorithms, add new analysis techniques and correlate the analysis results with specific combustion conditions in the cyclone. Second, it was not known if a method could be developed to adjust the air flow distribution within the cyclone using the analysis results to optimize the cyclone performance.

Systems that can accurately reflect combustion conditions are essential to advanced boiler management. In the case of low-$NO_x$ burners, accurate monitoring of burner-operating states is more important than for conventional burners because low-$NO_x$ burners are more sensitive to changes in operating parameters. Conventional combustion monitoring systems provide information that is averaged over many burners and long time scales (e.g., measurements of excess air, coal feed, or $NO_x$ emissions at time scales of several minutes or hours). However, large fluctuations in $NO_x$ emissions and carbon burnout can occur in individual burners over short time scales (i.e., between about 10 seconds to fractions of a second). These fluctuations produce widely different boiler performance for operating conditions that are otherwise indistinguishable. Accordingly, combustion diagnostics should reflect both long and short time-scale transients for more reliable boiler optimization. Cyclone furnaces contain added complexity that demands a more sophisticated combustion monitoring approach. Since the combustion is divided into two zones as described above, the distribution of primary and secondary air must be carefully controlled to achieve the desired degree of combustion.

A significant advantage of cyclone furnaces over wall-fired burners is that the ash (incombustible portion of fuel) is trapped in the cyclone barrel and leaves the boiler via a slag tap at the discharge end of the cyclone. It is very important that the slag be maintained in a free flowing state. If the slag freezes, the combustion in the cyclone will deteriorate and an unacceptable amount of the fuel may leave the cyclone unburned. The air flow distribution within the cyclone must be carefully controlled to maintain the slag in a free-flowing state as well as to achieve the desired degree of combustion.

A key variable in the combustion of fossil fuels, such as oil, gas and pulverized coal, is the air/fuel ("A/F") ratio. The A/F ratio strongly influences the efficiency of fuel usage and the emissions produced during the combustion process (especially, for low-$NO_x$ burners). Generally, lower A/F ratios produce lower NOx emissions. However, carbon monoxide and unburned carbon emissions may increase if the A/F ratio is too low. The A/F ratio also affects slagging, fouling and corrosion phenomena that typically occur in the combustion zone. In current steam generators fired with fossil fuel, the A/F ratio is controlled by measurement of oxygen and/or carbon monoxide ("CO") concentration in the stack gases or at the economizer outlet. In either case, the gas measurement is taken at a location removed from the actual location of the combustion process. Unfortunately, in multi-burner or multi-cyclone steam generator furnaces the A/F ratio may differ from burner to burner, or cyclone to cyclone. Since both combustion efficiency and $NO_x$ generation levels depend on the localized values of the A/F ratio (i.e., the distribution and mixing within each flame), measurement and control of the global A/F ratio alone does not necessarily optimize performance. Further, a minimum A/F ratio must be maintained in the cyclone to provide sufficient heat to maintain the slag in a free-flowing state.

In a cyclone a number of factors can alter the optimum A/F ratio during normal boiler operation. These variables include changes in fuel moisture or heating value, changes in fuel blend, changes in coal size distribution due to wear in the crusher or changes in coal grinding properties, changes in the overall air flow rate, and changes in the distribution of air among individual burners or cyclone barrels. All cyclone burners (especially with staged air and/or fuel injection) undergo characteristic transitions in dynamic stability (i.e., bifurcations) as the above parameters are varied. In the cyclone burners the most important burner bifurcations are caused by the nonlinear dependence of flame speed on the relative amounts of fuel and air present. In particular, flame speed (i.e., combustion rate) drops exponentially to zero when the A/F ratio approaches either fuel-lean or fuel-rich flammability limits. Fuel-lean refers to conditions where excess air (i.e., oxygen) is present and fuel-rich refers to conditions where excess fuel is present. Local variation in the A/F ratio creates some zones within the burner that sustain combustion and other zones that do not sustain combustion. These zones may interact through complex mechanisms that depend on the details of turbulent mixing imposed by burner design, specific operating settings, and the relative amounts and spatial distribution of incoming fuel and air. The complexity of the process is further increased by the presence of both solids and volatile components in the fuel, which mix and burn at characteristically different rates. The details of the distribution and interaction of combusting and non-combusting zones is critical in determining the efficiency of fuel conversion and the levels of pollutants emitted (such as oxides of nitrogen and carbon monoxide).

Extinction of combustion within the burner or along the length of the barrel represents a bifurcation in which the flame state is no longer stable. Generally, the primary air flow is minimized to keep coal in the burner long enough to initiate combustion. Extinction of combustion in the burner can occur if the primary air flow is too high, if there is an excessive amount of moisture present in the fuel or if the fuel is too coarse or a combination of all three. These changes in properties cause a delay in the release of volatile matter from the fuel resulting in a gas mixture outside of the flammability limit. Whether caused by high air velocity or excessively fuel-rich burner conditions, delayed combustion in the burner is an undesirable operating condition typically associated with excessive emissions of pollutants.

Currently, there is no good way to identify that the optimum amount of primary air is being fed to the burner. Knowing the air flow alone is not sufficient. It is also necessary to have a measure of the quality of combustion in the burner. Further, the optimum amount may change as the properties of the coal change, therefore requiring a means to continuously monitor the combustion in the burner and to provide guidance to the operator to make adjustments. U.S. Pat. Nos. 6,775,645 B2 and 6,901,351 B2 describe the methods to calculate time asymmetry (temporal irreversibility) and symbol sequence histograms from flame scanner signals.

Conventional signal analysis methods such as Fourier analysis and univariate statistics are based on assumptions that are not entirely valid for combustion in a cyclone burner or barrel. Specifically, Fourier analysis assumes that the described processes are linear (i.e., processes in which the observed behavior is produced by superposition of simple modes), while univariate statistics assumes that each event is random and independent from events at other times, i.e., there is no time correlation. When these assumptions are incorrect the results from Fourier analysis and univariate statistics can provide either misleading results or results that are insensitive to real differences (M. J. Khesin et al., "Demonstration Tests of New Burner Diagnostic System on a 650 MW Coal-Fired Utility Boiler," American Power Conference, Chicago, Ill., Volume 59-1, 1997; Krueger et al., "Illinois Power's On-Line Operator Advisory System to Control $NO_x$ and Improve Boiler Efficiency: An Update," American Power Conference, Chicago, Ill., Volume 59-1, 1997; Adamson, et. al., "Boiler Flame Monitoring Systems for Low $NO_x$ Applications—An Update," American Power Conference, Chicago, Ill., Volume 59-1, 1997; Khesin, M., et al., "Application of a Flame Spectra Analyzer for Burner Balancing," presented at the $6^{th}$ International ISA POWID/EPRI Controls and Instrumentation Conference, June 1996, Baltimore, Md.)

Chaos theory (especially, symbol sequence techniques and temporal irreversibility) avoids the assumptions of conventional analytical methods and thus may provide information unavailable from these well-known techniques. Chaos theory is a prominent new approach for understanding and analyzing deterministic nonlinear processes, which provides specific tools for detecting and characterizing fluctuating unstable patterns of these processes (Gleick, "Chaos: Making a New Science," Viking Press, New York, 1987; Stewart, "Does God Play Dice? The Mathematics of Chaos," Basil Blackwell Inc., New York, 1989; Strogatz, "Nonlinear Dynamics and Chaos," Addison-Wesley Publishing Company, Reading, Mass., 1994; Ott et al., "Coping with Chaos," John Wiley & Sons, Inc., New York, 1994; Abarbanel, "Analysis of Observed Chaotic Data," Springer, N.Y., 1996). Chaos theory has been applied to feedback systems and burner flame analysis (Wang et al. U.S. Pat. No. 5,404,298; Jeffers, U.S. Pat. No. 5,465,219; Fuller et al., "Enhancing Burner Diagnostics and Control with Chaos-Based Signal Analysis Techniques," 1996 International Mechanical Engineering Congress and Exposition, Atlanta, Ga., vol. 4, pp 281-291, Nov. 17-22, 1996; J. B. Green, Jr. et al., "Time Irreversibility and Comparison of Cyclic-Variability Models," *Society of Automotive Engineers Technical* Paper No. 1999-01-0221 (1999)). Because combustion is highly nonlinear, analytical techniques derived from chaos theory (especially, symbol sequence techniques and temporal irreversibility) may be particularly useful for burner flame analysis.

Thus, it has become apparent that a new method for monitoring the operating state of cyclone burners and barrels is needed. In particular, what is needed is a method that can monitor the operating states of individual burner and barrels using nonlinear analytical methods such as symbol sequence analysis and temporal irreversibility on a diagnostically meaningful time scale.

B&W and UT-Battelle (ORNL) completed a feasibility test, two baseline test series, and a demonstration test at the Ameren UE Sioux Plant that is located in West Alton, Mo. The inventors also completed two baseline test series and a demonstration test at the Alliant Energy Edgewater Plant located in Sheboygan, Wis. Data were collected at nominal operating conditions and some upset conditions. The dynamic content of the signals were analyzed using analysis techniques described in U.S. Pat. Nos. 6,775,645 B2 and 6,901,351 B2. Nonlinear statistics such as time asymmetry and symbol sequence patterns responded to changes in stoichiometry and primary/secondary/tertiary air split. In addition, it was determined that higher statistical moments of the flame scanner signals such as skewness and kurtosis strongly correlate with the symbol sequence patterns and time asymmetry in flame signals. Thus skewness and kurtosis can be used to supplement the information from the more advanced nonlinear features. The demonstration tests showed that the claimed method for adjusting air flow as guided by the analysis results effectively optimized the cyclone operation.

SUMMARY OF THE INVENTION

Therefore, it is an object of the invention to provide a method of optimizing operation of a furnace used to burn coal to produce steam for thermal processes and power generation.

It is another object to provide a method of enhancing proper air flow distribution in a cyclone furnace to optimize the performance of the furnace.

It is another object of the invention to provide a method to identify optimum air flow distribution and to maintain the optimum distribution as the properties of the coal vary over time.

It is a further object of the invention to provide a method that utilizes linear signal analysis techniques, and advanced nonlinear signal analysis techniques based on chaos theory, to analyze flame scanner signals from the lighter and main flame scanners.

According to a preferred embodiment of the invention a method of adjusting air flow distribution in a cyclone furnace is disclosed. The furnace is of the type having a plurality of cyclones, each cyclone having a barrel, an attached burner on one end of the barrel and a re-entrant throat on an opposing end, primary, secondary and tertiary air flow dampers for controlling air flow to the barrel and burner, over-fire air flow dampers, a lighter scanner and a main flame scanner in order to minimize $NO_x$ while maintaining acceptable carbon monoxide emissions, unburned carbon loss, and reliable cyclone operation. The method includes the steps of setting secondary air flow on each cyclone to a typical secondary air flow damper setting to provide equal secondary air flow to each cyclone, setting all over-fire air flow dampers to a same air flow value and closing the tertiary air flow damper. The primary air flow dampers are adjusted to 90-95% of a target sum of primary air flow and tertiary air flow as indicated by one or more flow measurement devices or the position of the primary air flow damper, and the tertiary air flow damper is adjusted to provide a balance of primary and tertiary air flow as indicated by flow measurement devices or the position of the primary and tertiary air flow dampers. Cyclone performance is assessed by analyzing flame scanner signals from the main flame scanner and lighter scanner in analysis software and generating statistics indicative of whether operational characteristics of one or more cyclones is inside or outside of predetermined variance limits, and increasing primary air flow or secondary air flow as appropriate to eliminate instability indicated by some or all of statistics being outside of ± variance limits. In the case of all cyclones indicating stable operation by reference to both main flame and scanner lighter signals, the primary air flow on each cyclone is decreased until the main flame scanner signal begins to exhibit instability as indicated by statistics drifting toward variance limits, while maintaining tertiary air flow at minimum flow. Upon adjustment of the primary air flow to a minimum value needed to achieve stable operation, secondary air flow is decreased by closing the secondary air damper on each cyclone stepwise and simultaneously until the lighter scanners begin to detect instability. Air flow to all overfire air ports is increased equally to maintain excess air flow while decreasing secondary air flow to the cyclones to a value corresponding to a minimum secondary air flow and maximum degree of staging for each cyclone and the overfire air ports dampers are adjusted as needed to compensate for any $O_2$ or CO imbalances resulting from the adjustments made to the cyclones.

In accordance with another embodiment of the invention, the secondary air damper comprises a plurality of separate secondary air damper segments spaced along the length of the barrel, and includes the step of varying the amount of air that is introduced into the barrel from individual segments along the length of the barrel.

In accordance with another embodiment of the invention, the method includes the step of introducing more air at the end of the barrel near the re-entrant throat than at the end of the barrel near the burner to maintain the slag in a free-flowing condition and to burn the combustion gases in an excess amount of air.

In accordance with another embodiment of the invention, the method includes the steps of storing in a data storage and retrieval device data representing various types of instabilities for being categorized in a library of flame states for the cyclones; and comparing current analysis results data in the library of flame states.

In accordance with another embodiment of the invention, the method includes the steps of the analyzing results and recommendations from the analysis software and adjusting a set point bias on one or more of the primary, secondary or tertiary damper positions.

In accordance with another embodiment of the invention, the method includes the step of providing direct communication between the analysis software and a control system to allow for automatic change in set point bias values in response to a command signal from the software.

In accordance with another embodiment of the invention, the burner is selected from the group consisting of a radial, burner, vortex burner and scroll burner.

In accordance with another embodiment of the invention, the method includes the step of establishing a limit on a bias for primary air flow rate or damper position.

In accordance with another embodiment of the invention, the method includes the step of establishing a bias on secondary air flow rate or damper position.

In accordance with another embodiment of the invention, the method includes the step of producing a time varying signal that is indicative of fluctuating combustion conditions within the burner or barrel.

In accordance with another embodiment of the invention, the method includes the step of utilizing a drift of time varying value of statistics with respect to variance limits to generate a command signal to adjust the air distribution.

In accordance with another embodiment of the invention, the method includes the step of constraining any overcompensation in an air flow control algorithm by using a moving average of the statistics smooth out spikes in the statistics and provide a more representative process variable to guide the control system response.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
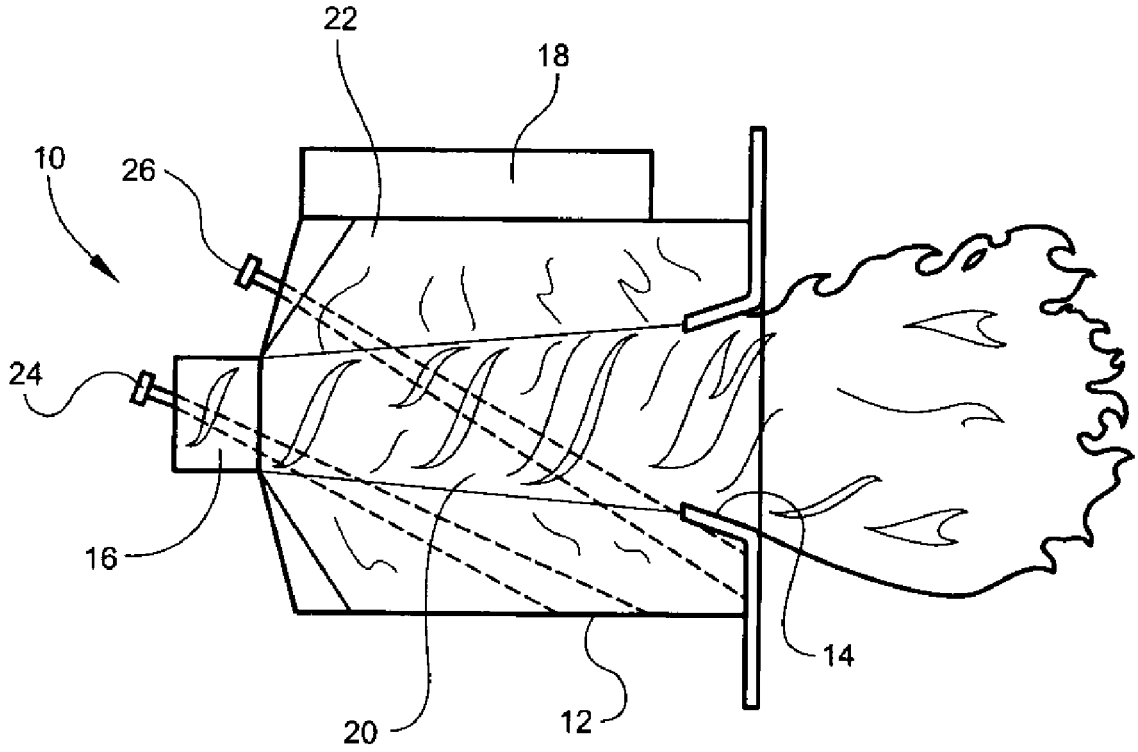
FIG. 1 is a schematic view of a typical cyclone furnace illustrating flow patterns sighting of scanners.

Referring now specifically to the drawings, a typical cyclone of the type utilized in the practice of the methods according to this invention is shown generally in FIG. 1 at reference numeral 10.

The cyclone 10 includes a barrel 12 having a re-entrant throat 14. A burner 16 is mounted so as to project a flame into the re-entrant throat 14. The burner 16 may be of the radial, scroll or vortex type. A secondary air throat 18 mounted in an offset position between the burner 16 and the re-entrant throat 14. The interior of the barrel 12 defines a central vortex zone 20 and a surrounding recirculation zone 22. A main flame scanner 24 and a lighter scanner 26 are positioned to detect conditions and generate signals within the barrel 12 and burner 16 indicative of the operation of the system.

The main flame scanner 24 detects flame instabilities resulting from insufficient primary and/or tertiary air in the burner 16. The lighter scanner 26 detects flame instabilities resulting from insufficient secondary air in the barrel 12. The signals for the main flame and lighter scanners 24, 26 are relatively independent, thereby allowing for independent control of the primary air flow to the burner 16 and secondary air flow to the barrel 12. In general, instabilities in the burner 16 or barrel 12 have only a minor effect on the combustion conditions in the other zone. This finding was unexpected and non-obvious. It was expected that a strong correlation would exist between combustion events in the burner 16 and barrel 12. Contrary to this expectation it was discovered that the combustion in the burner and barrel zones is essentially independent. Cross correlation analysis did not show a strong dependency. Therefore, analyses of the burner 16 and barrel 12 can be decoupled and the corrective action implemented independently.

Variations in statistics based on simple visual qualitative inspection of the statistics do not emerge until the air flows drop below a critical value. The sensitivity is improved by applying quantitative statistical tests. The critical value corresponds to the onset of instability in the air flow distribution and combustion.

Figure 2:
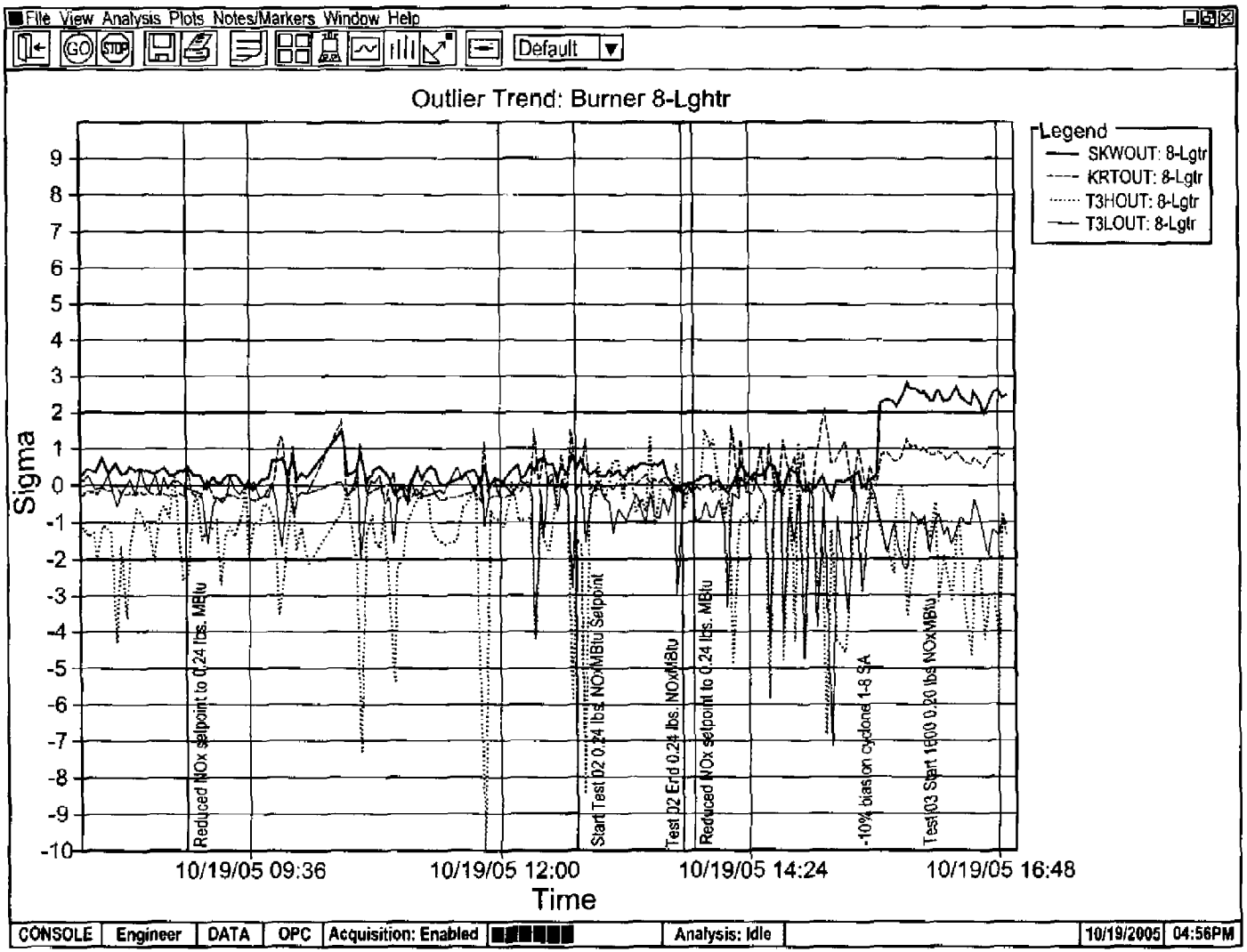
FIG. 2 is a chart showing the response of the barrel lighter scanner signal to reduction in $NO_x$ set point and associated change in secondary air flow.

Referring now to FIG. 2, response of the statistics to a lowering of the $NO_x$ set point is shown. As the $NO_x$ set point is lowered the amount of secondary air being fed to the cyclone barrel 12 is reduced. Less secondary air causes instability in the combustion and this is reflected in the drift of the statistics (in this case skewness and time asymmetry low) outside the variance limits.

An optimal condition is achieved by adjusting the corresponding air flow slightly above the critical value. Below the critical value, the statistics change in proportion to the deviation from optimal. Therefore, the statistics can provide a quantitative indication of the adjustment that is needed to restore optimal operation.

Above the critical value, the statistics do not change with increases in air flow. Once a stable flame is achieved, typical variations in air flow do not substantially affect stability since the cyclone is inherently stable when operated unstaged.

Typically, the optimal primary and tertiary air split is approximately 5% of the total amount of air supplied as tertiary and 10-15% supplied as primary air. Cyclone burners operate best with minimal tertiary air. Tertiary air is adjusted to keep the burner face cool.

A series of tests was performed in which the primary and tertiary air split was varied over a wide range of combinations. The statistics of skewness, kurtosis, temporal asymmetry and symbol sequence clearly indicated a condition in which the sum of primary air and tertiary air flow is too low. However, the analysis did not uniquely discriminate a condition in which the total flow is too low due to insufficient primary air or tertiary air individually.

Figure 3:
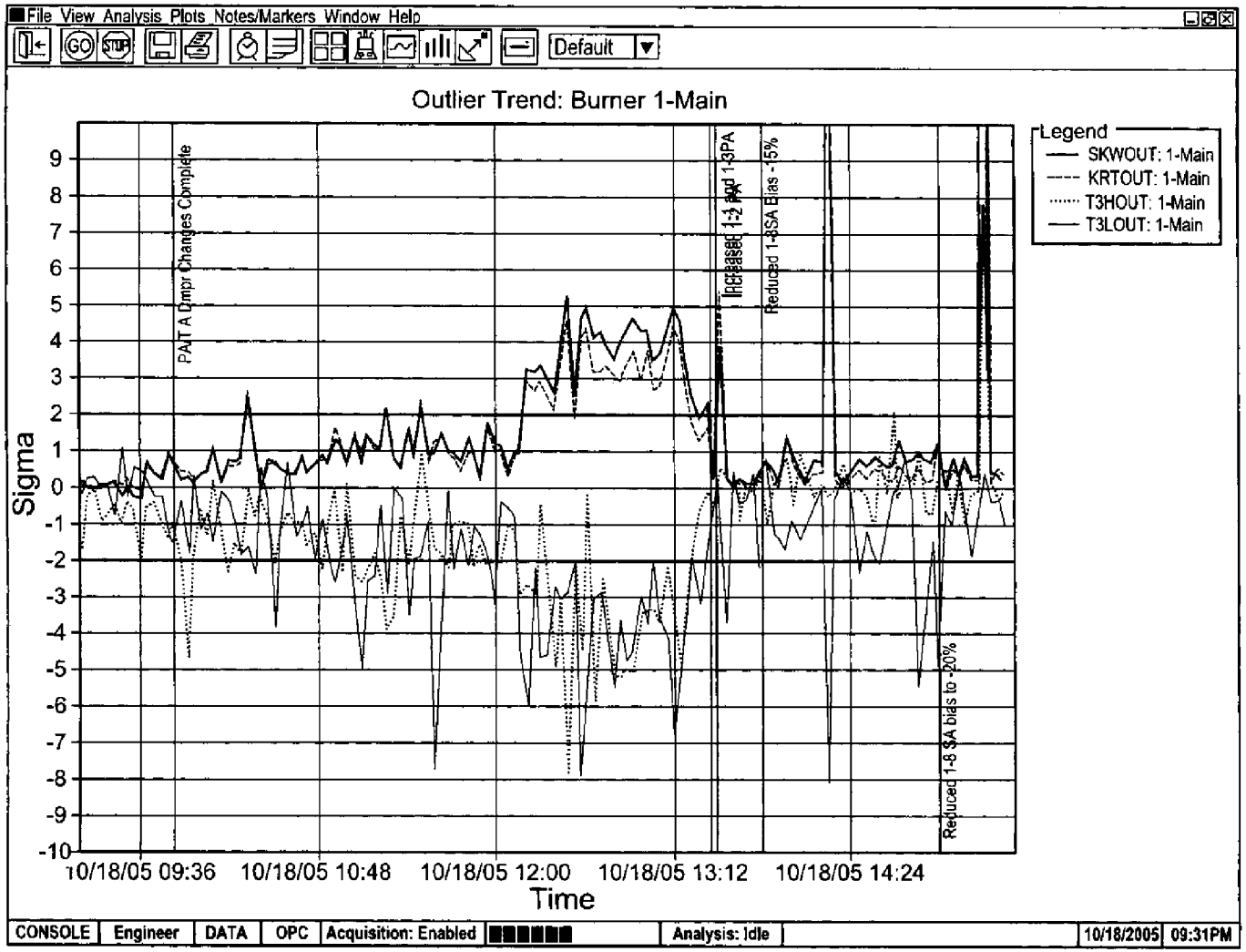
FIG. 3 is a chart showing the response of the cyclone burner to control action applied to primary air flow.

As is shown in FIG. 3, the response of the burner flame scanner signal from the main flame scanner 24 reacts to an adjustment in primary air flow. As the primary air flow is reduced below the critical value, statistics drifted outside the variance limits. As the primary air flow was increased back to optimum, the statistics returned to a range within the variance limits.

Figure 4:
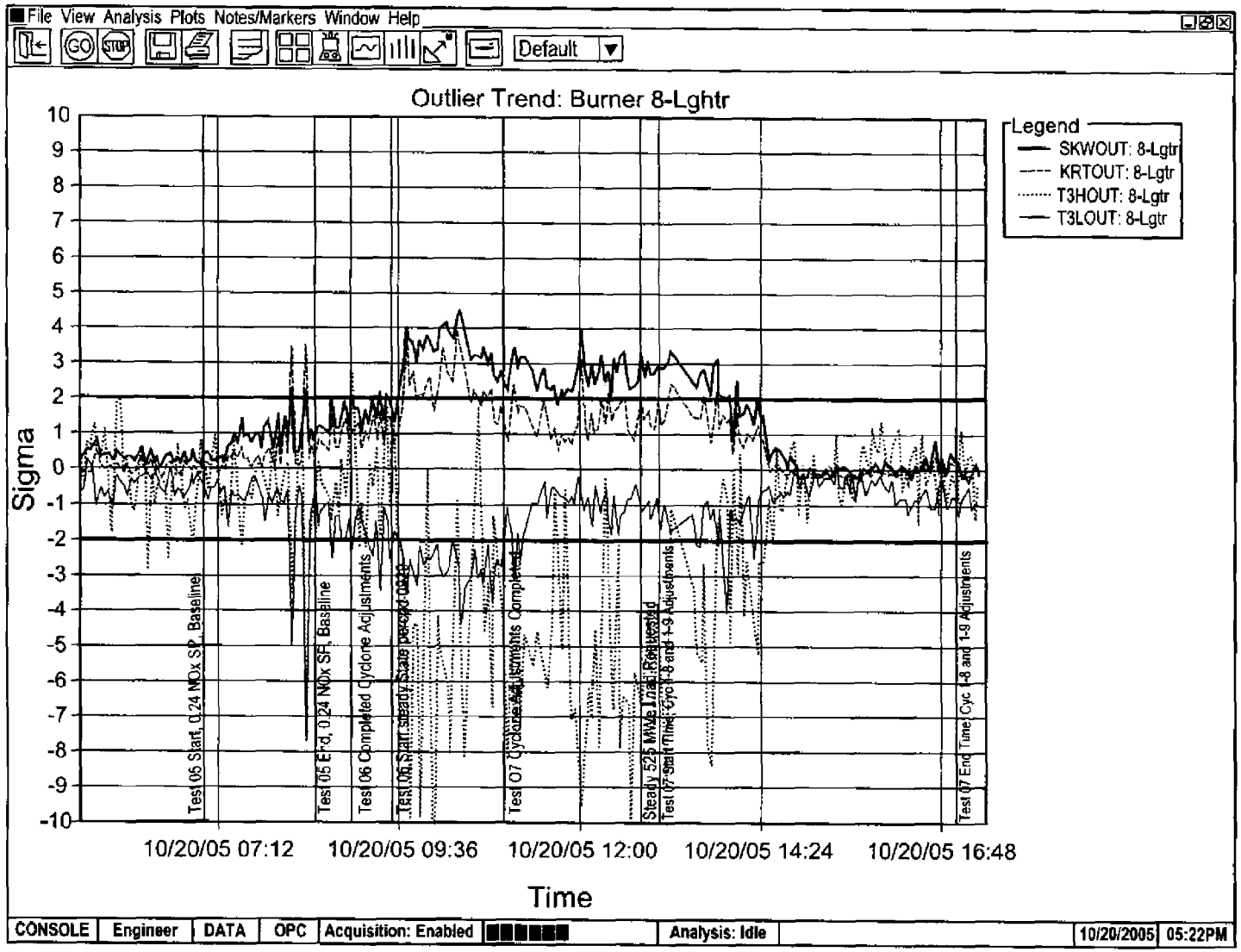
FIG. 4 is a chart showing the response of the cyclone barrel lighter scanner signal to control action applied to secondary air flow.

FIG. 4 demonstrates the response of statistics for changes in secondary air flow to the cyclone barrel 12. A decrease in secondary air flow to the barrel 12 causes a reduction in the cyclone barrel gas temperature and slag temperature. The reduction in temperature causes instability in the overall combustion of the cyclone barrel which is reflected in the lighter flame scanner signal. As the secondary air flow is increased the combustion becomes stable and the statistics return to values within the variance limits.

Two types of information are provided to the operator. First, the technique identifies the current status of the cyclone. It is beneficial to have an indication of the current state of the condition of each cyclone, and a comparison of the performance of the cyclones with each other.

Figure 5:
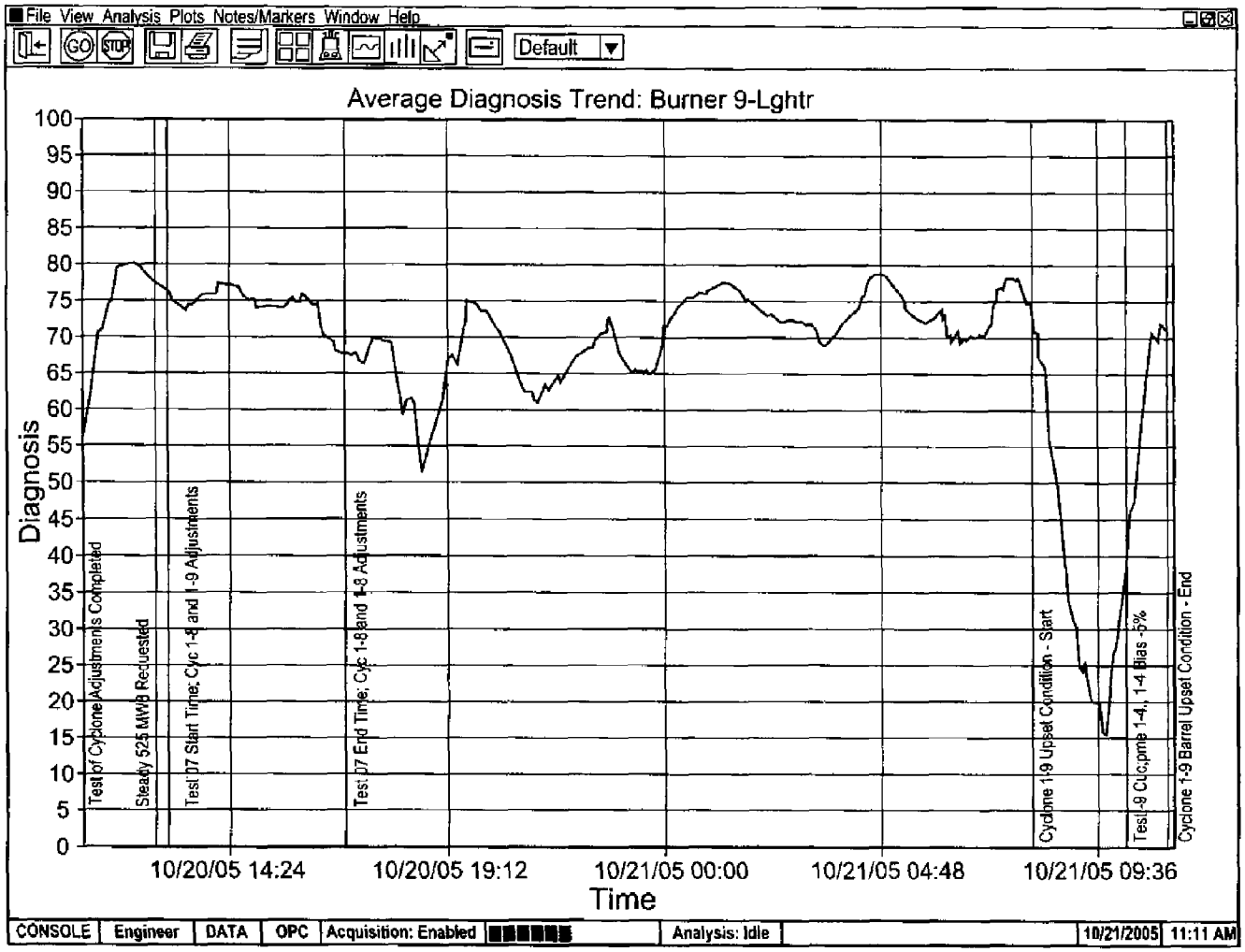
FIG. 5 is a chart showing the overall diagnosis trend of cyclone stability to upset condition in barrel.

An example of the change in overall assessment of the cyclone condition is shown in FIG. 5, where an overall diagnosis assessment on a scale of 0-100% is plotted. FIG. 5 shows that when an upset condition occurs, the overall diagnosis value drops significantly, reaching a low of 15%. Second, a means of tracking drift in cyclone operation due to formation of deposits, slow variations in coal properties, changes in slag properties, etc. is provided. Once air flows are adjusted properly and maintained constant, the technique can identify instabilities or changes in cyclone performance due to second-order effects. It is well known that in some cases upsets can occur due to changes in coal properties even if air flows are adjusted properly, for example, wet coal can trip a cyclone. It is beneficial to detect the onset of these changes and alert the operator, before a catastrophic event occurs.

Windbox pressure can have a significant effect on cyclone flame stability. Insufficient windbox pressure adversely affects the flow patterns in the cyclone resulting in poor mixing, and consequently, poor combustion.

The coal blend can have a significant impact on the stability of the cyclone. For example, for a given level of staging, a richer blend of eastern bituminous coal (e.g., 70/30 PRB/Bituminous vs 80/20 PRB/Bituminous) may be more stable. Therefore, conceivably, the optimum cyclone operating conditions could be adjusted as a function of coal blend.

Figure 6:
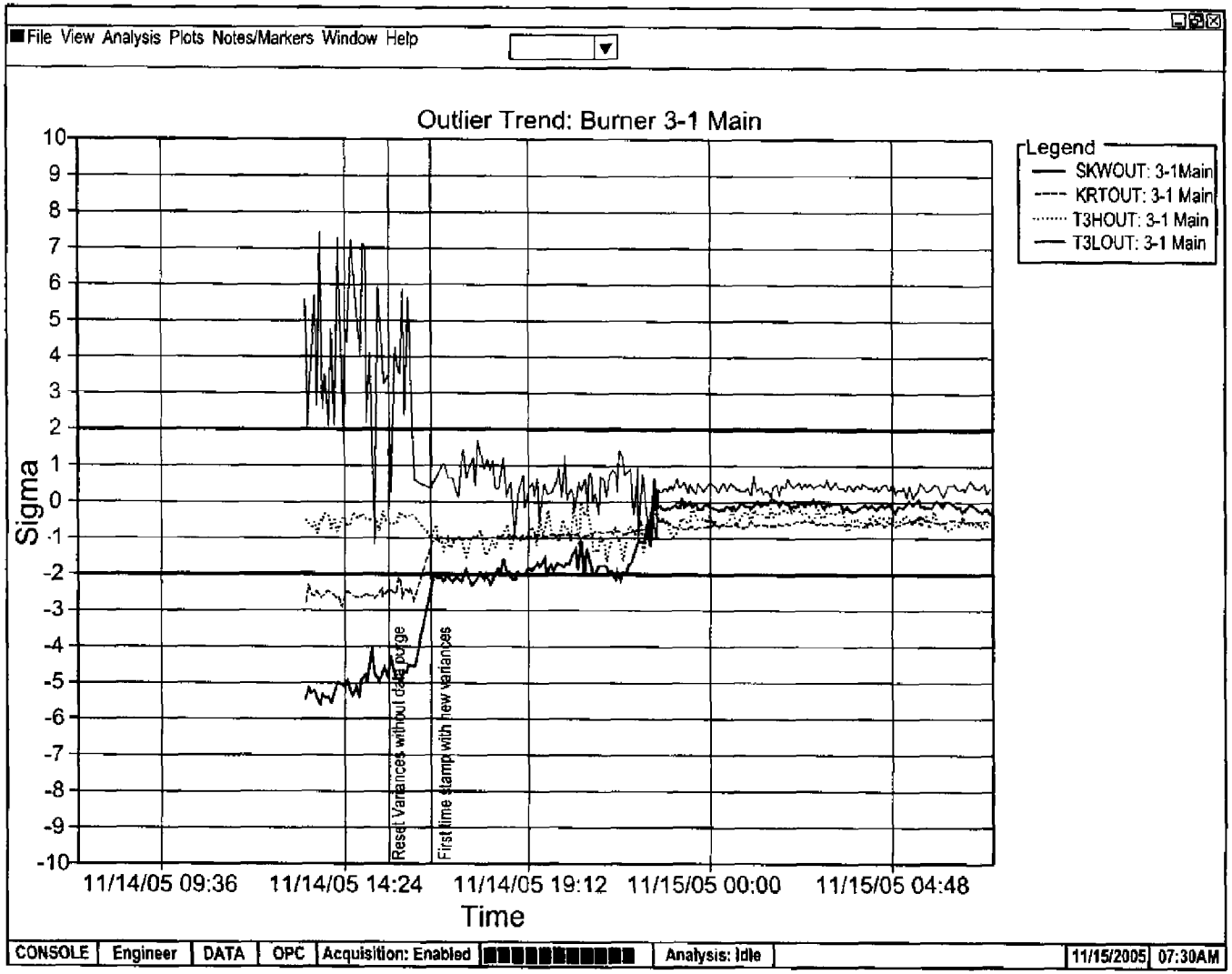
FIG. 6 is a chart showing the effect of resetting variances in analysis to improve resolution of analysis techniques.

The analysis techniques claimed in U.S. Pat. Nos. 6,775,645 B2 and 6,901,351 B2 were enhanced to track drift in cyclone operation and identify the potential root cause(s) of the drift. Variance bands, as shown in FIG. 6 are established by averaging data for a period of time to ensure statistically valid results. The variance limits are displayed on a graph along with the data. The variance bands can be reset to improve the resolution of the analysis techniques and effectiveness of the control scheme.

Figure 7:
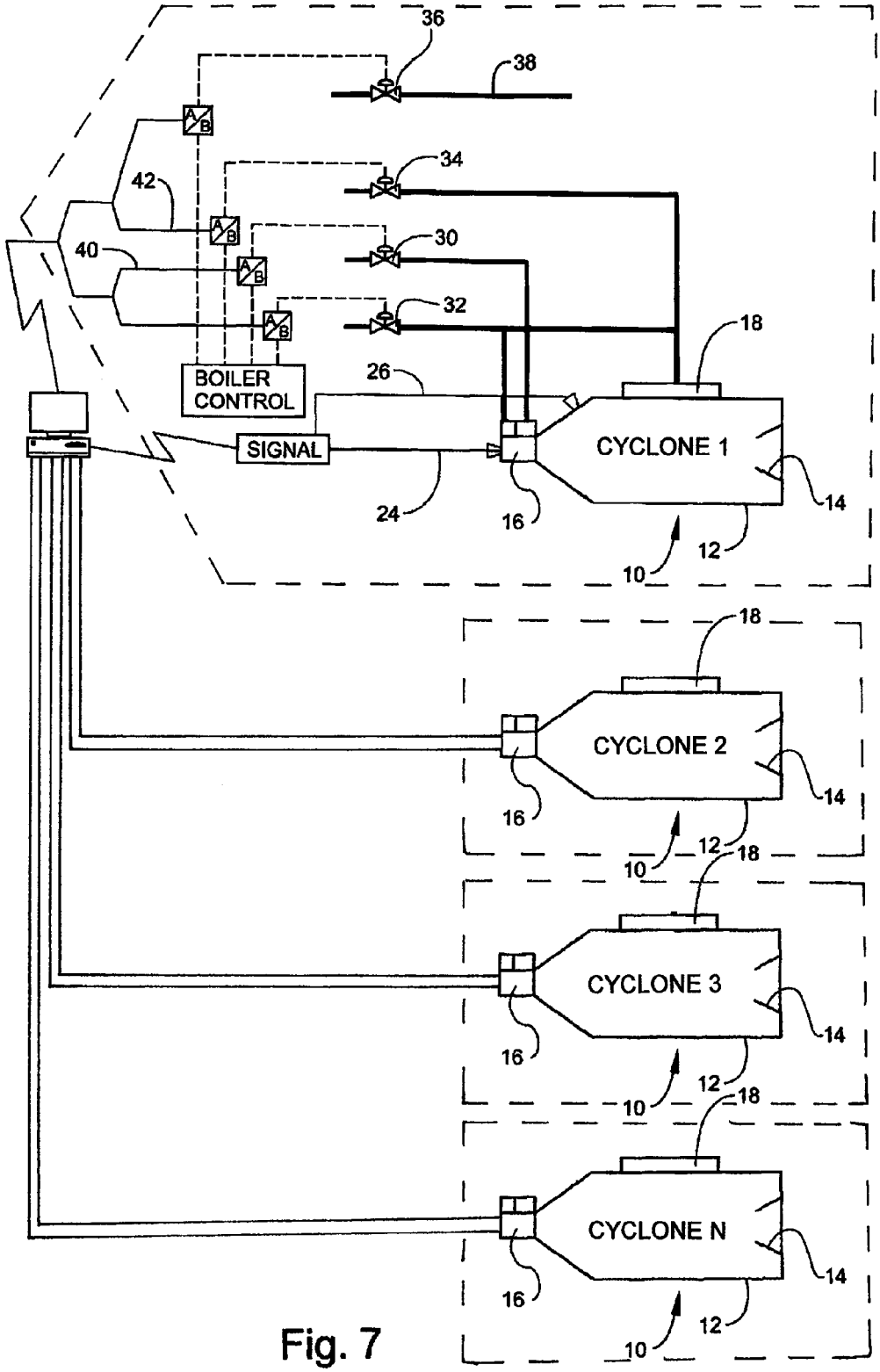
FIG. 7 is a simplified control schematic of the control system.

With these considerations and principles in mind, a methods to adjust the air flow distribution is now described with reference to FIG. 7, which includes the cyclone of FIG. 1. The main flame scanner 24 is used to adjust the flow of primary air through the primary air damper 30 and tertiary air flow through the tertiary air damper 32, and to detect instabilities due to coal grind, moisture or blend.

The lighter scanner 26 is used to adjust secondary air flow through the secondary air damper 34, and to detect instabilities due to improper distribution in secondary air flow and slag properties.

The analog model for the control method is a single acting flow control valve with spring return. The air flows are held to minimum unless otherwise directed by the results of the analysis of the flame scanner signals.

The primary objective is to minimize $NO_x$ while maintaining acceptable carbon monoxide emissions, unburned carbon loss, and reliable cyclone operation, i.e., uniformly flowing slag. In a preferred embodiment of the invention, a fixed coal blend is used, with a single secondary air damper 34 and separate primary and tertiary air dampers 30, 32 in a radial burner cyclone design.

The method is preferably implemented in an open-loop, advisory mode.

If the boiler is staged, the secondary air flow is set to a typical damper setting with the secondary air damper 34, providing equal secondary air flow to each cyclone as best determined by plant instrumentation e.g., static pressure in duct, differential pressure across flow measurement device, and the like. Over-fire air flow dampers 36 are set to the same damper position to cause equal air flow through each. The tertiary air flow damper 32 is then closed.

The primary air flow damper 30 is manually adjusted to 90-95% of the target sum of the primary air flow and tertiary air flow as indicated by flow measurement devices or the position of the primary air damper 30. The tertiary air flow damper 32 is then used to provide balance of primary and tertiary air flow as indicated by flow measurement devices. The cyclone performance is assessed by analysis of the flame scanner signals from the main flame scanner 24 and lighter scanner 26. For cyclones 10 indicating instability in burner 16 or barrel 12 as indicated by statistics outside variance limits, the primary air flow or secondary air flow is increased as appropriate to eliminate instability. Instability is indicated by some or all of statistics being outside of ± variance limits.

With all cyclones 10 indicating stable operation in both main flame and scanner lighter signals, the primary air flow is decreased on each cyclone until the main flame scanner signal just begins to exhibit instability, as indicated by statistics drifting toward variance limits. Tertiary air flow is maintained at minimum flow.

After adjusting the primary air flow to the minimum value needed to just achieve stable operation, the secondary air flow on each cyclone is decreased by closing the secondary air damper 34 stepwise, and simultaneously until the lighter scanner 26 just begins to detect instability.

Simultaneously, air flow to all overfire air ports 38 is increased equally to maintain overall excess air while decreasing secondary air flow. This corresponds to minimum secondary air flow and maximum degree of staging for each cyclone 10. If the secondary air flow is reduced further, there would be insufficient heat released in the cyclone 10 to keep the slag free flowing. Note that the air flow and/or damper positions on all cyclones 10 will likely not be the same.

Finally, the overfire air dampers 36 are adjusted as needed to compensate for any $O_2$ or CO imbalances resulting from the adjustments made to the cyclones 10.

This method for tuning the cyclones 10 should result in the maximum staging and minimum emissions of $NO_x$. It provides a direct, non-iterative approach for tuning cyclones. Once tuned, the method can then be used to detect upsets in operation due to other factors such as coal properties or slag properties using the tracking feature.

A temporary upset in operating conditions is compensated for by adjusting cyclone operation. If the instability is apparent in the main flame scanner signal, compensation is achieved by providing a positive bias to the primary air flow until the instability is eliminated.

If the instability is apparent in the lighter scanner signal, compensation is achieved by providing a positive bias to the secondary air flow until the instability is eliminated.

The air biases (primary air bias 40 and secondary air bias 42) are reduced on a timed basis to verify that the temporary upset has passed and conditions can be restored to optimal.

When combined with a neural network boiler optimizing software, the method can be used to identify optimum settings on individual cyclones and over-fire air ports for a given coal blend. The optimal settings for each coal blend can be stored in the control system. As the coal blend changes, the primary air bias 40 and secondary air bias 42 can be adjusted automatically to adjust the cyclone settings and the degree of staging to achieve optimal conditions for that blend.

The method described above reduces the need for the operator to visually inspect the cyclone, provides independent control of the air flow to the cyclone burner and barrel, and provides an instantaneous assessment of cyclone state as well as an indication of drift in cyclone performance and operation. The method also provides an independent measure of the stability of combustion in the burner and barrel. The invention does not rely solely on the measurement of air flow to the burner or barrel to determine optimum operating condition. This is important, because as fuel properties change, the air flow may have to be changed to maintain optimum operation.

In some cases, air monitors are installed on the cyclones to measure primary, secondary and tertiary air flow. These monitors can be expensive to install and maintain. Not all cyclones are equipped with quantitative indications of air flow. The invention therefore provides a basis for complementing existing air flow measurement systems or providing a semi-quantitative measure of combustion stability for those cyclones that do not have a quantitative measure of air flow.

In addition, the method is inherently self-adjusting. Optimum $NO_x$ emissions are achieved by operating the cyclone substoichiometrically. However, unburned carbon emissions and carbon monoxide emission can increase at low stoichiometries. Also, if there is insufficient heat release in the barrel due to less combustion, the slag temperature may drop causing the slag to freeze. The research leading up to this invention demonstrated that upsets in cyclone operation due to poor combustion and freezing slag are apparent in the flame scanner signal and the analysis results track the change and therefore can be used to correct the upset.

The method can be readily customized to a wide range of actuator configurations, and can be implemented on cyclone furnaces that have manually actuated dampers as well as pneumatically or electromechanically actuated dampers. The method can also be implemented in open-loop or closed-loop control.

Variations on the above-described method are also possible. For example, rather than using a single secondary air damper to control the amount of secondary air that is introduced to the cyclone barrel, some cyclones are equipped with dampers that are divided into two or three separate segments. The purpose of this design modification is to enable the operator to vary the amount of air that is introduced into the barrel along the length of barrel. Typically, a cyclone operates better by introducing more air at the end of the barrel near the re-entrant throat. This approach keeps the slag flowing freely by burning the combustion gases in an excess amount of air. Thus, the position of the split air dampers may be varied to improve the quality of the statistics. Varying the position of the split air dampers may also provide improved stability allowing a further reduction in the total secondary air flow to the cyclone and a correspondingly more substoichiometric operation resulting in lower $NO_x$ emissions. The described method also provides a direct indication that the slag is freezing.

The optimum condition and various types of instabilities can be categorized in a library of flame states for the cyclones. The current analysis results can be compared to the entries in the library of flame states to identify a match. The information can be provide to the operator.

Typically, the primary and tertiary air dampers 30, 32 are manually-adjusted dampers. These dampers 30, 32 can optionally be configured with a pneumatic or hydraulic actuator and the position thus adjusted based on guidance from the described method.

As noted above, the method described provides for open loop or advisory control i.e., the operator views the analysis results and recommendations from the analysis software and adjusts a set point bias on damper position. The method could be modified to allow for direct communication between the analysis software and the plant's control system to allow for automatic change in set point bias values in response to a command signal from the software. The method can be applied to a cyclone furnace equipped with a vortex burner or a scroll burner. The method is independent of burner type. Some minor adjustment to the library entries in the analysis software may be required.

In some instances, practice of the disclosed method may result in the analysis software generating a demand signal that will cause the primary air or secondary air to be increased or reduced beyond a desired limit. Although stable operation of the cyclone burner 16 or barrel 12 can be achieved at very low air flow rates, other factors may require that a minimum lower limit on primary, secondary or tertiary air be established. For example, since erosion of refractory materials can be worse under reducing conditions, it may be desirable to set a limit on the bias for primary air flow rate or damper position, or bias on secondary air flow rate or damper position. Since tertiary air is sometimes used to cool the front face of the cyclone burner, it may be desirable to set a limit on tertiary air damper position or flow rate to avoid thermal distortion of the burner face. Mechanical stops can be installed on manual dampers to prevent the dampers from being closed below a minimum setting.

For dampers configured with pneumatic, hydraulic or electromechanical actuators, the position of the dampers can be adjusted from a control room. Limits can be programmed into the control system that will limit either the bias on damper position or the absolute position of the damper or both.

The method can be applied equally well to a slagging combustion furnace which is a variation on the cyclone furnace design. In addition, boiler performance optimizer programs, such as neural networks, that acquire process data and adjust operating set points can be utilized to achieve and maintain optimum operation. The analysis results of the analysis software can be acquired by the neural net and be used to assess current performance and improve operation and performance.

The main flame scanner 24 and lighter scanner 26 must produce a time varying signal that is indicative of the fluctuating combustion conditions within the burner or barrel. The signals can be analyzed with the same analysis software. The analysis results can be correlated to specific operating conditions within the cyclone. Library members can be created based on the analysis results.

The method as described uses the drift of time varying value of statistics with respect to variance limits to generate a command signal to adjust the air distribution. This could lead to overcompensation in the control algorithm. The overcompensation can be constrained by using a moving average of the statistics which tends to smooth out spikes in the statistics and provide a more representative process variable to guide the control system response.

Although the method as described assumes a staged cyclone furnace 10, the method can also be applied to unstaged cyclone furnaces. The method can be used to detect upsets in slag properties due to high moisture content in the coal, coarse grind size, and change in fuel ash properties.

A method of boiler flame diagnostics and control is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method of adjusting air flow distribution in a cyclone furnace of the type having a plurality of cyclones, each cyclone having a barrel, an attached burner, primary, secondary and tertiary air flow dampers for controlling air flow to the barrel and burner, over-fire air flow dampers, a lighter scanner and a main flame scanner in order to minimize NOx while maintaining acceptable carbon monoxide emissions, unburned carbon loss, and reliable cyclone operation, the method comprising the steps of:

(a) setting secondary air flow on each cyclone to a typical secondary air flow damper setting to provide equal secondary air flow to each cyclone;

(b) setting all over-fire air flow dampers to a same air flow value;

(c) closing the tertiary air flow damper;

(d) adjusting the primary air flow dampers to 90-95% of a target sum of primary air flow and tertiary air flow as indicated by one or more flow measurement devices or the position of the primary air flow damper;

(e) adjusting the tertiary air flow damper until a minimum tertiary air flow at which a balance of primary and tertiary air flow as indicated by flow measurement devices or the position of the primary and tertiary air flow dampers is achieved;

(f) assessing cyclone performance by analyzing the flame scanner signals from the main flame scanner and lighter scanner and generating statistics indicative of whether operational characteristics of one or more cyclones is inside or outside of predetermined variance limits;

(g) increasing primary air flow or secondary air flow as appropriate to eliminate instability indicated by some or all of statistics being outside of ± variance limits;

(h) in the case of all cyclones indicating stable operation by reference to both main flame and scanner lighter signals, decreasing primary air flow on each cyclone until a minimum primary air flow is reached at which the main flame scanner signal begins to exhibit flame instability as indicated by statistics drifting toward variance limits, while maintaining tertiary air flow at minimum flow;

(i) upon adjustment of the primary air flow to a minimum value needed to achieve stable operation, decreasing secondary air flow by closing the secondary air damper on each cyclone stepwise and simultaneously until a minimum secondary air flow is reached at which the lighter scanners begin to detect instability;

(j) simultaneously increasing air flow to all overfire air ports equally to maintain excess air flow while decreasing secondary air flow to the cyclones to a value corresponding to a minimum secondary air flow and maximum degree of staging for each cyclone; and (k) adjusting the overfire air port dampers as needed to compensate for any $O_2$ or CO imbalances resulting from the adjustments made to the cyclones.

2. A method according to claim 1, wherein the secondary air damper comprises a plurality of separate secondary air damper segments spaced along the length of the barrel, and includes the step of varying the amount of air that is introduced into the barrel from individual segments along the length of the barrel.

3. A method according to claim 2, and including the step of introducing more air at the end of the barrel near the re-entrant throat than at the end of the barrel near the burner to maintain the slag in a free-flowing condition and to burn the combustion gases in an excess amount of air.

4. A method according to claim 1, and including the steps of storing in a data storage and retrieval device data representing various types of instabilities for being categorized in a library of flame states for the cyclones; and comparing current analysis results data in the library of flame states.

5. A method according to claim 1, and including the steps of analyzing results and recommendations from the analysis software, and adjusting a set point bias on one or more of the primary, secondary or tertiary damper positions.

6. A method according to claim 5, and including the step of providing direct communication between the analysis software and a control system to allow for automatic change in set point bias values in response to a command signal from the software.

7. A method according to claim 1, wherein the burner is selected from the group consisting of a radial, burner, vortex burner and scroll burner.

8. A method according to claim 1, and including the step of establishing a limit on a bias for primary air flow rate or damper position.

9. A method according to claim 1, and including the step of establishing a limit on a bias on secondary air flow rate or damper position.

10. A method according to claim 1, and including the step of setting a limit on tertiary air damper flow rate for avoiding thermal distortion of a face of the burner.

11. A method according to claim 1, and including the step of producing a time varying signal that is indicative of fluctuating combustion conditions within the burner or barrel.

12. A method according to claim 1, and including the step of utilizing a drift of time varying value of statistics with respect to variance limits to generate a command signal to adjust the air distribution.

13. A method according to claim 12, and including the step of constraining any overcompensation in a air flow control algorithm by using a moving average of the statistics smooth out spikes in the statistics and provide a more representative process variable to guide the control system response.

* * * * *